US005242564A

United States Patent [19]

Traini

[11] Patent Number: 5,242,564

[45] Date of Patent: Sep. 7, 1993

[54] DEVICE FOR REMOVAL OF GAS-LIQUID MIXTURES FROM ELECTROLYSIS CELLS

[75] Inventor: Carlo Traini, Milan, Italy

[73] Assignee: S.E.R.E. S.r.l., Italy

[21] Appl. No.: 850,413

[22] Filed: Mar. 12, 1992

[30] Foreign Application Priority Data

Mar. 21, 1991 [IT] Italy ..... MI91000766

[51] Int. Cl.[5] ..... C25B 9/00; C25B 15/08

[52] U.S. Cl. ..... 204/258; 204/266; 204/270; 204/279

[58] Field of Search ..... 204/255-258, 204/263-266, 270, 279

[56] References Cited

U.S. PATENT DOCUMENTS

| | | | |
|---|---|---|---|
| 3,945,908 | 3/1976 | Hempell et al. | 204/258 X |
| 4,557,816 | 12/1985 | Yoshida et al. | 204/255 |
| 4,632,739 | 12/1986 | LaValley | 204/258 X |
| 4,705,614 | 11/1987 | Morris | 204/258 X |
| 4,839,012 | 6/1989 | Burney et al. | 204/255 |
| 5,139,635 | 8/1992 | Signorini | 204/258 X |

*Primary Examiner*—Donald R. Valentine
*Attorney, Agent, or Firm*—Bierman and Muserlian

[57] ABSTRACT

The present invention relates to a device for removing gas-liquid mixtures from electrolysis cells divided into compartments, particularly membrane type cells, without producing pressure fluctuations, wherein each compartment of said cells is characterized in that it is provided with two different ducts for removing the mixture after separation into liquid-rich and gas-rich phases, each duct being connected with its first end to the upper part of the cell, while the other end of the gas-rich phase duct (4) is inserted into the liquid-rich phase duct (3) so that liquid is present only in the portion of the duct comprised between the connection to the cell and the point of inlet of the gas-rich phase. In the subsequent portion the flow consists in the gas-liquid mixture which is forwarded to a gas-disengaging vessel. As said second end of the gas-rich phase duct (4) is inserted into the liquid-rich phase duct (3), sufficient pressure is maintained in the upper gas-separating area of the cell to prevent the liquid-rich phase from entering the gas-rich phase duct (4).

7 Claims, 7 Drawing Sheets

DEVICE FOR REMOVAL OF GAS-LIQUID MIXTURES FROM ELECTROLYSIS CELLS

DESCRIPTION OF THE INVENTION

Recently a revolution occurred in the industrial electrolysis field due to the development and commercialization of ion-exchange polymeric membranes, such as Nafion®/Du Pont de Nemours, Flemion®/Asahi Glass and others. Such ion-exchange membranes are produced in the form of sheets, even of considerable dimensions, with a thickness that ranges from 0.2 to 0.5 mm max. Although provided with a reinforcement fabric, membranes are still affected by a low mechanical resistance, especially to abrasion and bending.

Due to the availability of membranes in sheet-form, electrolysis cells had to be redesigned into an essentially flat shape, reducing their thickness and volume. As a consequence of this new design, membrane electrolysis cells may present problems concerning uneven internal distribution of the electrolyte as well as inefficient removal of the liquid-gas mixture when the products of electrolysis are gaseous such as for example in chlor-alkali or water electrolysis. The problem of removing the gas-liquid mixtures from both cathodic and anodic compartments of said cells is of great concern. In fact, strong pressure fluctuations in both compartments would be experienced with an improper design of the outlets causing damages to the membranes in very short periods of time. These anomalous pressure fluctuations may be ascribed to the alternating of the gas-liquid phases entering the outlet duct on the top of the cell. The inconvenience connected to the pressure fluctuations, although typical of membrane cells, is also common to other types of cells, generally cells of the divided type, where the anode and the cathode together with the relevant compartments are divided by any kind of separator, such ion exchange membranes as discussed above, porous diaphragms and the like.

Technical literature discloses several ways to face this problem, leading substantially to the following two solutions:

collecting the gas-liquid phase through a downcomer, that can be positioned inside the cell itself (Uhde GmbH), or outside the same (Chlorine Engineers), as described in 'Modern Chlor-Alkali Technology', vol. 4, Society of Chemical Industry, Elsevier 1990. This kind of device produces a flow of the falling film type with a constant-with-time flow of liquid (a falling film covering the internal surface of the duct) and gas (in the central section, free from liquid) and efficaciously eliminates pressure fluctuations. Nevertheless, the aforesaid device can be utilized only in cells working under forced circulation, and not in cells with a natural circulation, caused by the produced gas (gas lift or gas draft). This limitation is of great relevance as natural circulation membrane cells offer particular advantages due to their high recirculation capacity, eg. the possibility of easily controlling the electrolyte acidity (pH), which, in chlor-alkali electrolysis for instance, permits to properly adjust the oxygen content in the produced chlorine gas.

removal of gas and liquid phases through a duct positioned inside the cell itself (U.S. Pat. No. 4,839,012, assigned to The Dow Chemical Co.) This collector, consisting in a horizontal pipe duct of the same length as that of the cell, is parallel to the higher edge of the cell and as close to it as possible. The collector, connected to the port through which gas and liquid phases are removed, is provided with suitable holes, approximately set by the superior generatrix. This device, referred to as pressure fluctuation dampening device, is fit for installation both in forced and in natural circulation cells. Nevertheless, the efficiency of such a device is only partial, since the residual absolute pressure pulses are in the range of 200–300 mm of water which could induce in the worst case a pressure pulse differential in the order of 600 mm of water between the two surfaces of the membrane with the possibility of experiencing damages due to fatigue caused by the membrane flexing near the edges, and abrasion of the membrane as a consequence of the rubbing against the electrode surface.

The present invention discloses a device for the removal of gas and liquid phases in membrane electrolysis cells to substantially eliminate pressure fluctuations, consequently prolonging the useful lifetime of the membrane by practically preventing the risk of damages due to abrasion or fatigue. More generally, said device is useful in all types of the so-called divided cells.

This surprising result, of extreme importance both under a technical and an economical point of view, can be attained by supplying each compartment of the electrolytic cell (whose products are gaseous) with two separate ducts for removing respectively the gas-rich and the liquid-rich phases which separate in the top of the cell compartment. The gas phase duct enters the cell above the connection between the cell itself and the liquid phase duct; furthermore the other end of said gas duct is inserted into the liquid phase duct in a position not at all critical, the only requirement concerning its distance from the point of connection of the liquid phase duct to the top of the cell, such distance should substantially be kept at least to a multiple (for instance three times) of the equivalent diameter of the connection itself. The insertion of the other end of the gas-rich phase duct inside the liquid-rich phase duct represents an important feature of the present invention; in this way a suitable pressure is maintained in the top of the cell filled by the gas-rich phase, and the liquid level is stabilized in such a position as to prevent the liquid itself from flowing into the gas phase duct and the gas-rich phase from being injected into the liquid phase duct. As a consequence, the minimum level of the liquid should never drop below the superior tangent to the section of the connection between the cell and the liquid phase duct. The height of the cell area filled with gas should not exceed a critical value in the range of a few centimeters, in order to ensure a constant wetting of the ion-exchange membrane, caused by sprays and waves naturally ensuing from the separation of gas from liquid. Said condition is essential for a regular and prolonged operation of the membrane which, on the contrary, would quickly embrittle due to drying and gas diffusion. Said pressure in the top of the cell may be obtained with alternative embodiments, such hydraulic heads and regulating valves, as will be discussed later on.

The invention will now be described in details by referring to the following figures.

Figure 1:
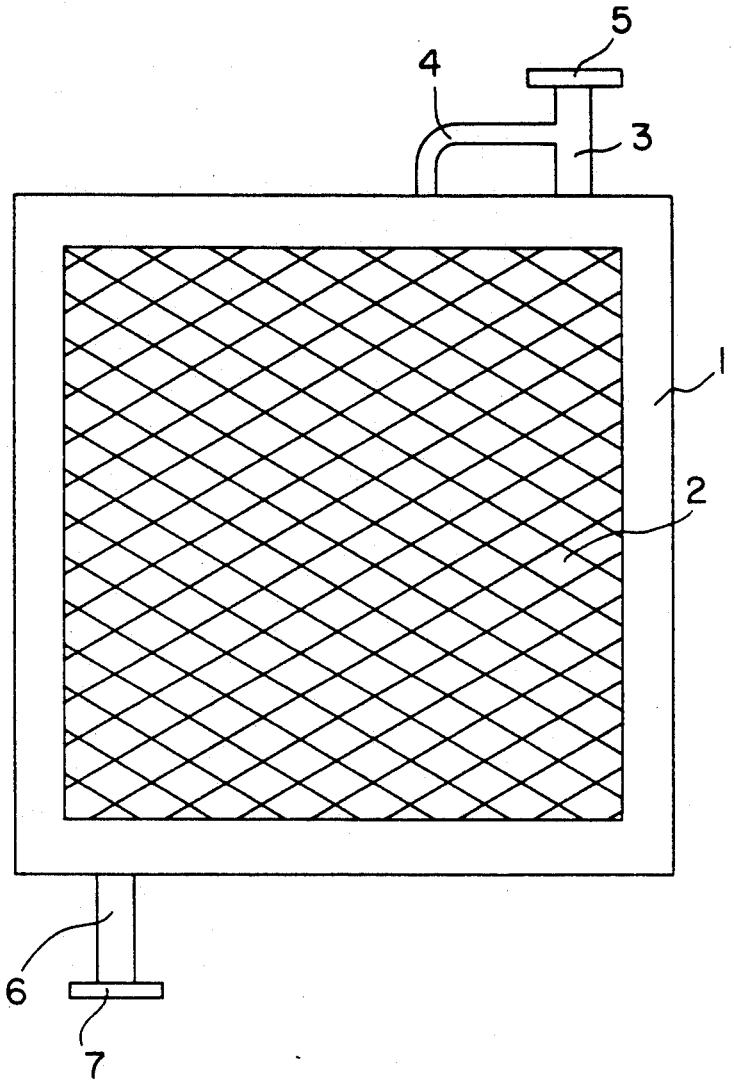
FIG. 1 is a front view of a cell of membrane electrolyzer equipped with the device of the invention.

FIG. 1 shows a cell of a membrane electrolyzer equipped with a frame (1) to ensure, together with suitable gaskets, a waterproof sealing along the edges of the several cells assembled to form the electrolyzer in the so-called "filter-press configuration". The cell comprises also an electrode (2) consisting in a foraminous sheet, such as expanded or perforated sheet or a screen provided, if necessary, with an appropriate electrocatalytic coating; an inlet (6) and an outlet duct (3); flanges (7, 5) for connection to feeding and removal loops, as known in the art. The cell is also supplied, according to the present invention, with a duct (4) for the removal of gas-rich products, one end of which is connected to the top of the cell and the other to the middle portion of outlet duct (3) for the removal of the liquid-rich phase.

Figure 2:
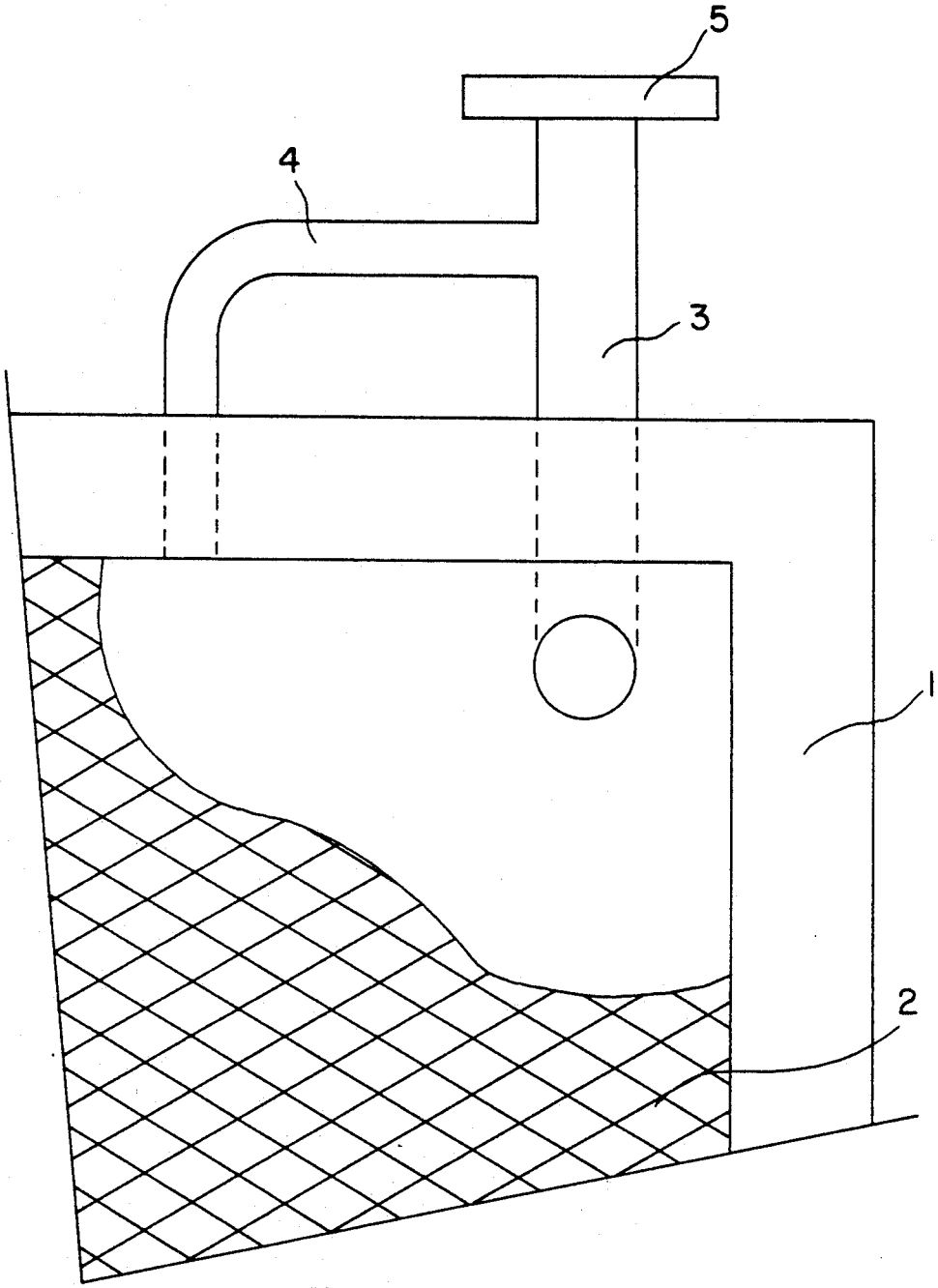
FIG. 2 shows a detail of the device of the invention.

FIG. 2 shows a detail of the cell comprising the two ducts (4, 3).

Figure 3:
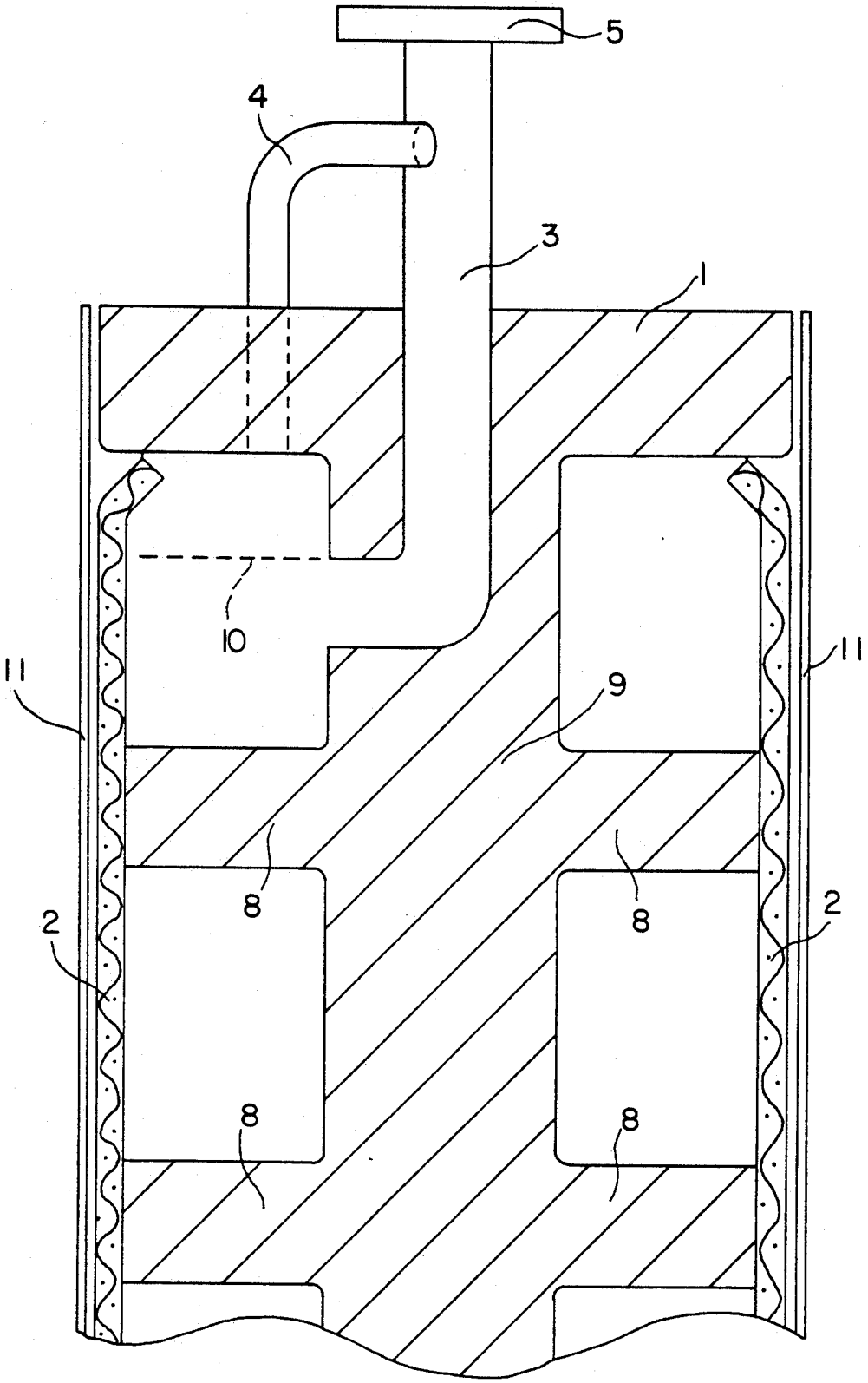
FIG. 3 is a cross section of a cell illustrated in FIG. 2 of a bipolar electrolyzer
Figure 4:
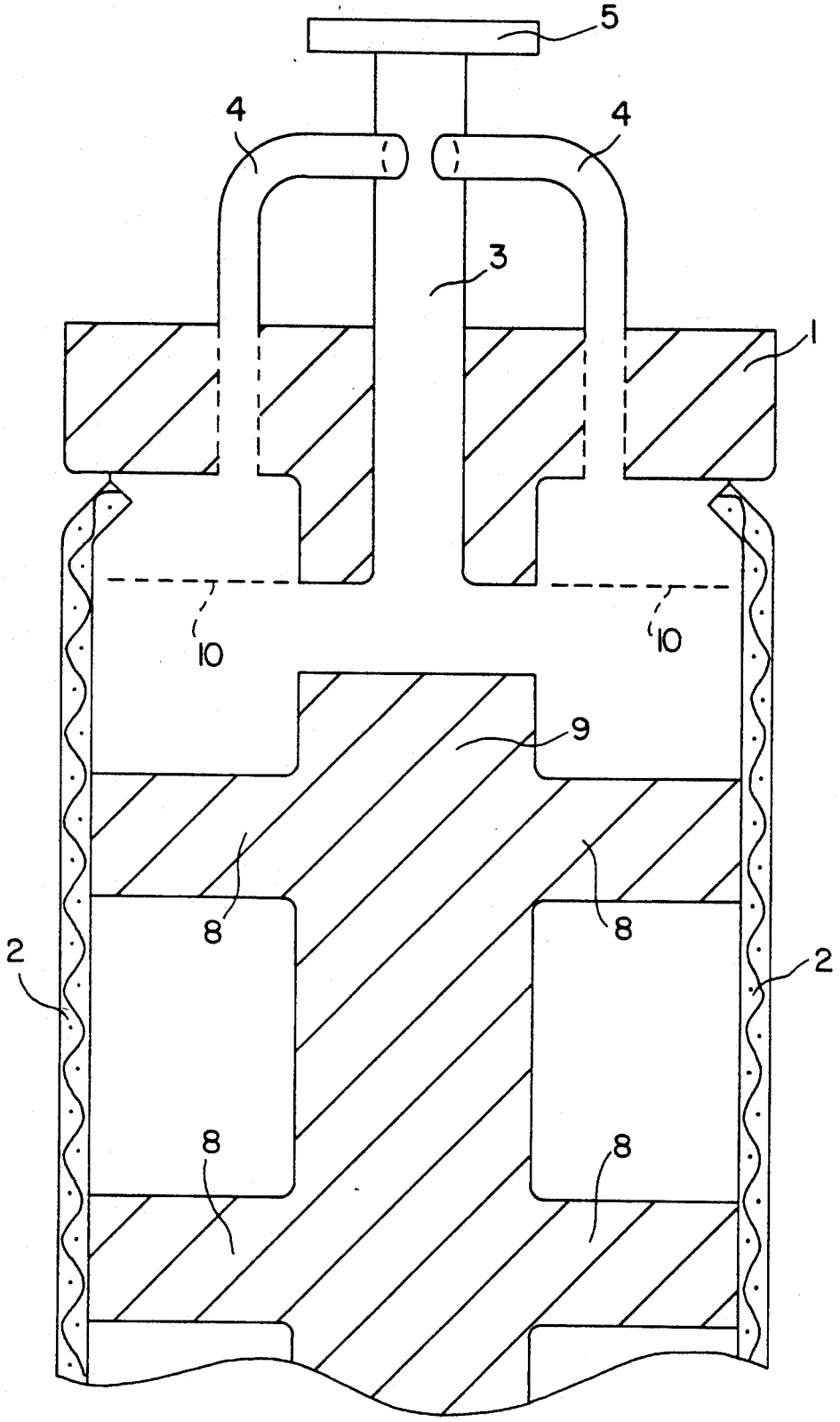
FIG. 4 is a similar cross section of a cell of a monopolar electrolyzer.

With reference to FIG. 3, it can be seen that the electrodes (2) are mechanically fastened or welded to the studs (8) protruding from the central body (9) providing both for the rigidity of the cell and for the transmission and distribution of electric current. The body (9) and the studs (8) may have different designs other than those illustrated in FIG. 3, 4, 7, without reducing the usefulness of the present invention. The generation of gas on the electrode surface (2) causes the formation of a gas-electrolyte mixture in an upward movement. In the top of the cell the mixture tends to separate back into a gasrich and a liquid-rich phase; in the prior art, characterized by a single type of outlet (duct (3) shown in FIG. 3 or a similar device), the removal of the two phases involved the generation of pressure fluctuations, negatively affecting the useful lifetime of the ion-exchange membrane (11) adjacent to the electrode (2).

The utilization of the device of the present invention surprisingly minimizes the pressure fluctuations, thus preventing their negative effect on the useful lifetime of the ion-exchange membrane. The reasons for such a positive and highly important result cannot be clearly understood at present; an explanation could be found in the fluid mechanics of the top of the cell. As it can be seen in FIG. 3, if the level of the liquid phase is maintained above the tangent line (10) over the outlet but below the inferior edge of the flange (1), where the outlet (4) is positioned, then a constant fluid removal is obtained. In particular, the gaseous phase contained in the top of the cell between line (10) and the inferior edge of the flange (1), is conveyed exclusively into duct (4) together with small quantities of liquid. The liquid phase, still containing gas residues, is withdrawn from duct (3). Said situation fundamentally differs from the prior art where a single outlet is provided and the gaseous and liquid phases, once separated in the top of the cell, alternate forcedly. The stabilization of the liquid level between line (10) and the edge of the flange (1) requires an appropriate balancing of the section and the length of the ducts (3, 4), in the area comprised between the outlet from the cell and the point wherein the two pipes meet, with the aim of maintaining said pressure in top of the cell below the pressure drop which occurs inside the duct for the liquid-rich phase removal; on the other hand the minimum value of said pressure in the top of the cell should never decrease below the value of the total pressure drop inside the duct for the liquid-rich phase removal subtracted by the height of liquid defined by line (10) and the edge (1) of the flange.

FIG. 5 and 6 show further embodiments of the present invention, wherein the elements are equipped with an outlet duct for the liquid-rich phase situated in a horizontal position.

Figure 5A:
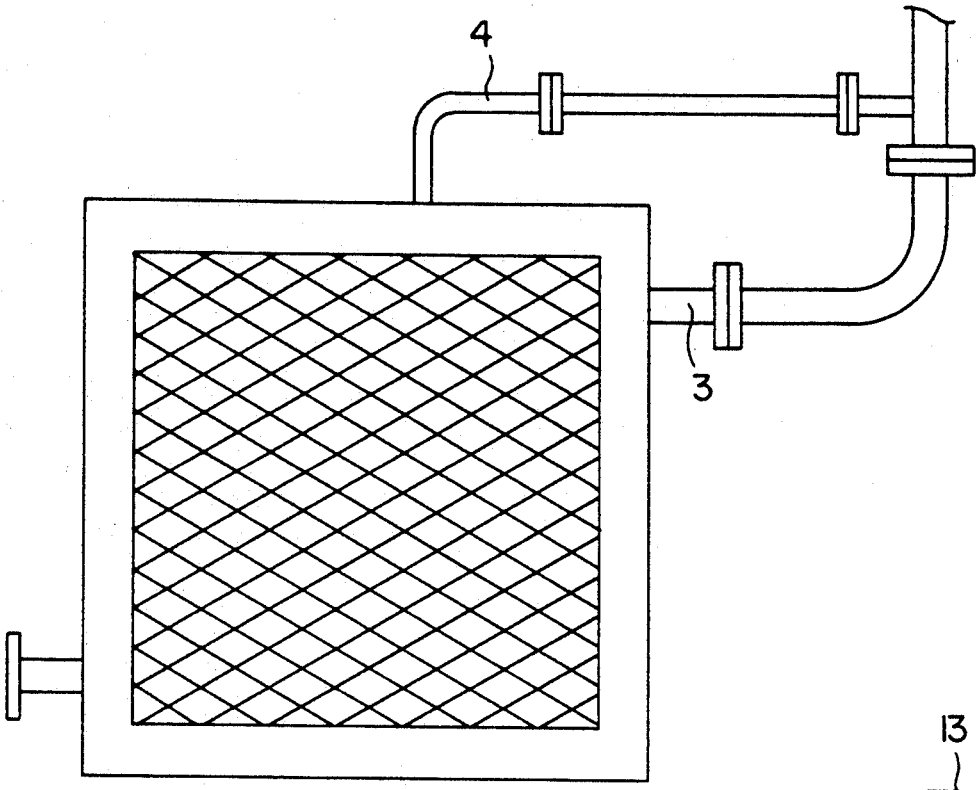
FIG. 5, 6 and 7 are front views of a membrane cell with different embodiments of the device of the invention.
Figure 5B:
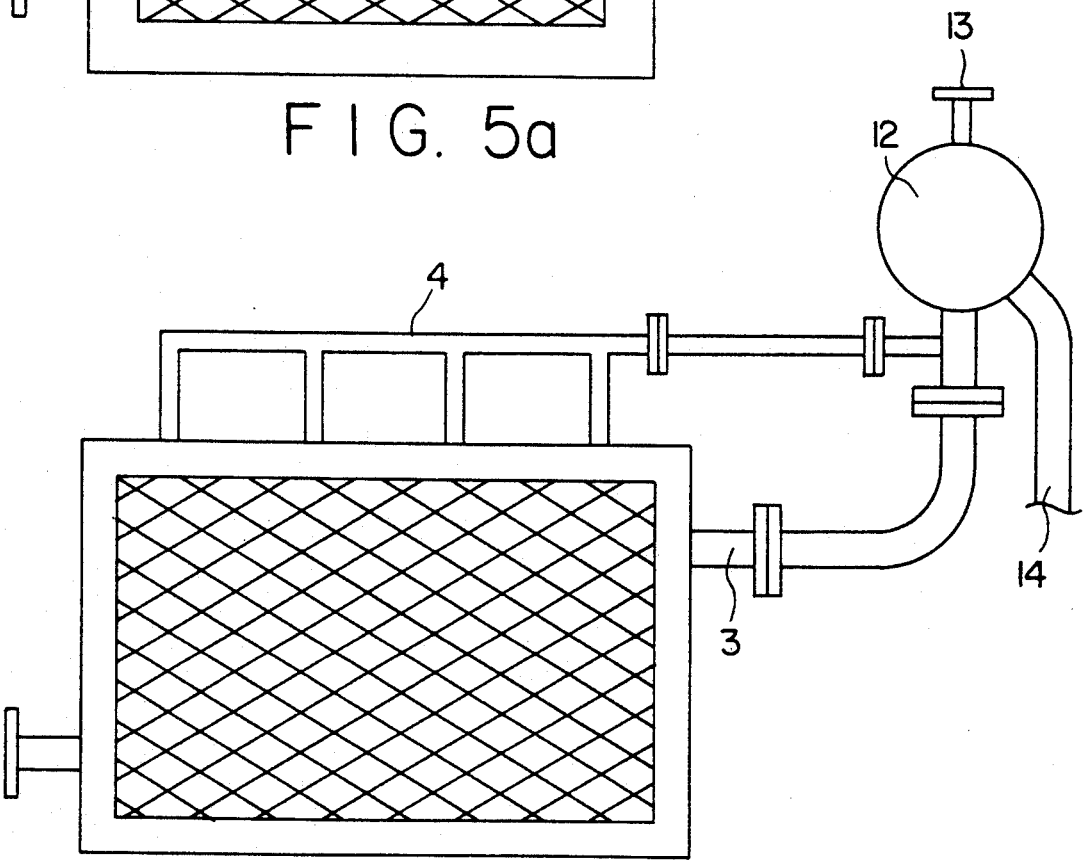
Figure 6A:
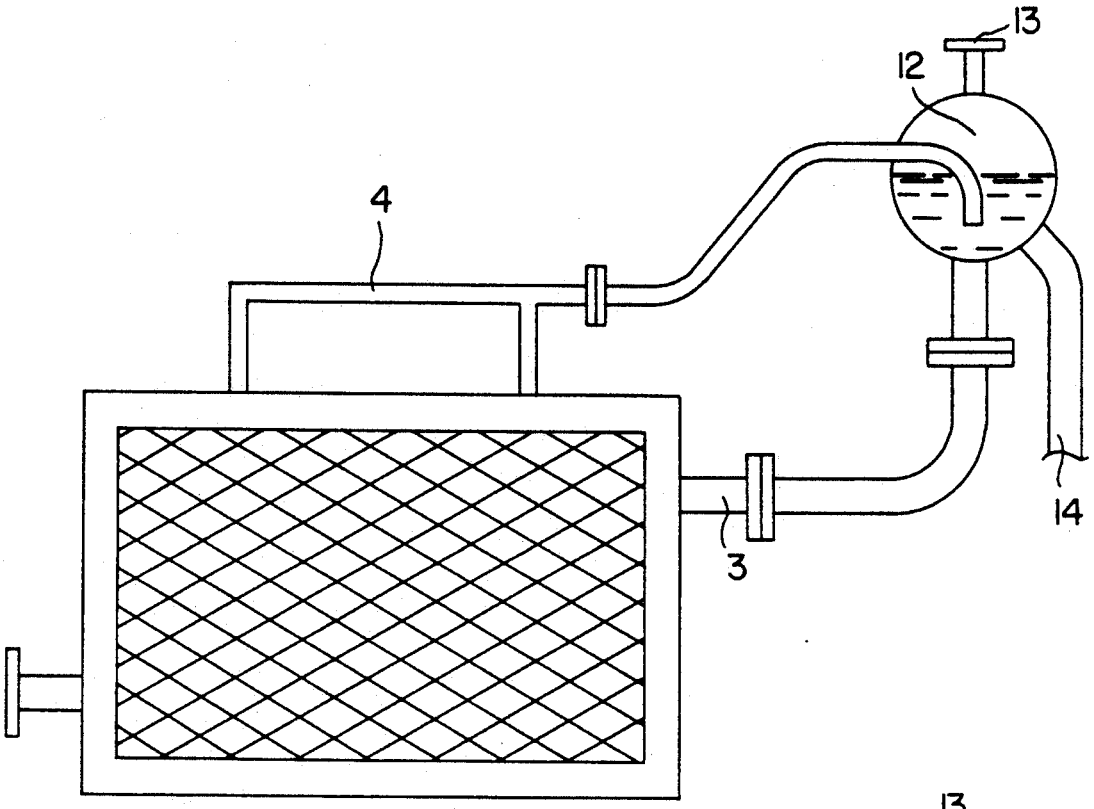

As it can be noted in FIG. 5*a*, the duct for the gas-rich phase (4) is connected to the liquid-rich phase duct (3) at a distance from the cell outlet significantly greater than the usual distance in cells with a vertical outlet (FIG. 1, 2, 3, 4). As a matter of fact, the insertion of the gaseous phase duct (4) into the liquid phase duct (3) is made in a position which is not at all critical with the only requirement that the cross section and length of ducts (3, 4) between the outlet from the cell and the conjunction of the two ducts meet the above discussed condition necessary for stabilization of the liquid level inside the cell. FIG. 5*b* and 6*a* schematize two embodiments of a large size cell provided with more than one gas-rich phase ducts (4) with two different types of connections to the liquid phase duct, respectively before the gas-disengager (12) (FIG. 5*b*), provided with a gas and a liquid outlet, and directly into the gas-disengager (12) under an appropriate hydraulic head (FIG. 6*a*).

Figure 6B:
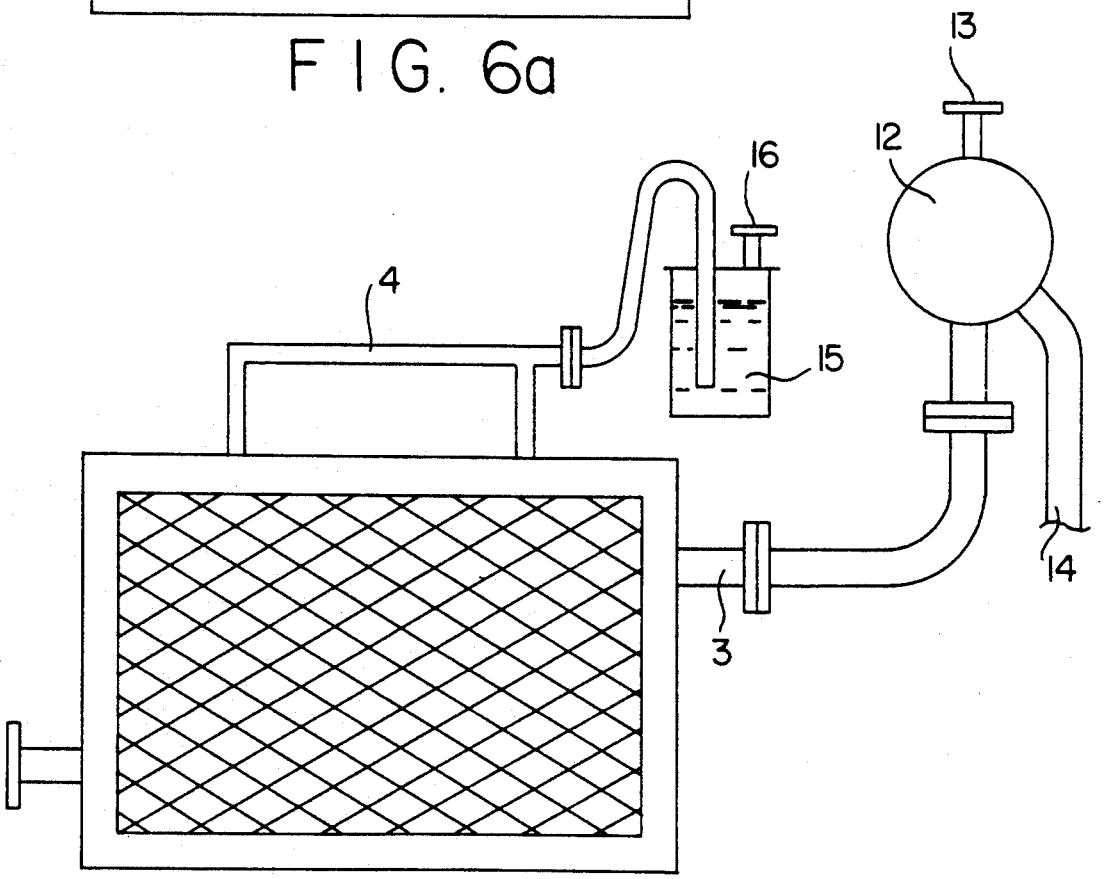

FIG. 6*b* shows alternative embodiments of the present invention, wherein the gas phase duct is connected to a hydraulic seal system (15) containing a suitable quantity of electrolyte and equipped with an outlet for gas (16).

From a practical point of view, said embodiment can be obtained by connecting all the gas-rich phase ducts (4) to a common collector, wherein the pressure is controlled by a single hydraulic seal system or an equivalent device.

Figure 7A:
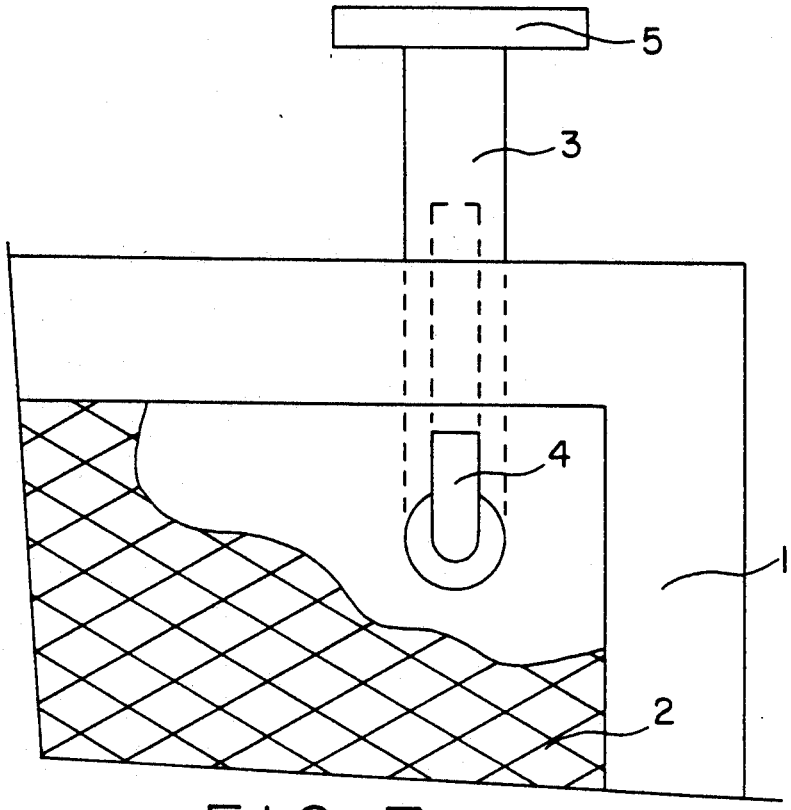
Figure 7B:
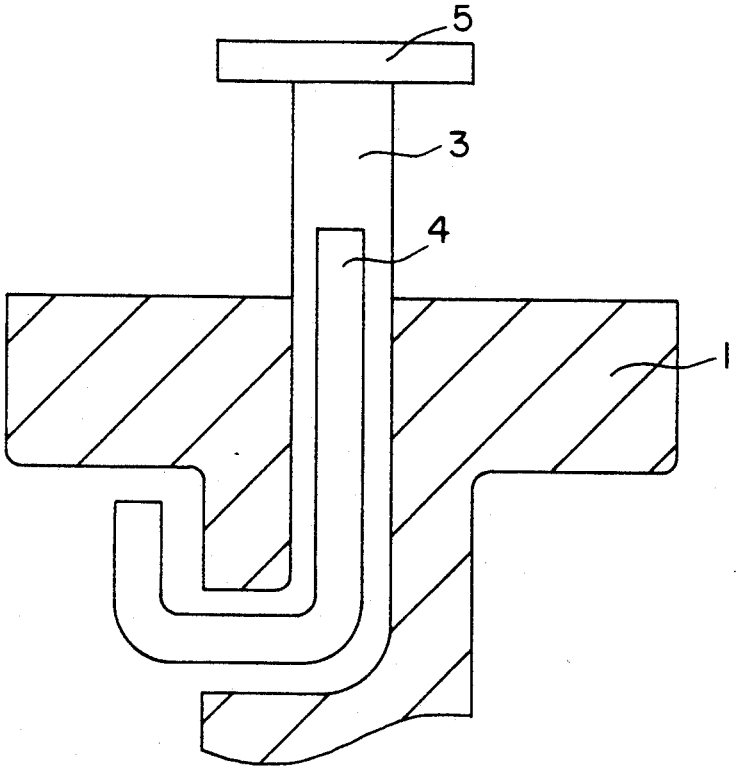

FIG. 7 schematizes a further embodiment of the invention, wherein the two ducts ((3) and (4)) for separately removing the liquid and the gas phases are coaxial; this embodiment presents the advantage of eliminating the connection between the gas phase duct (4) and the flange (1), with a consequent reduction of production costs and an increase of the element mechanical reliability.

EXAMPLE 1

An experimental electrolyzer of monopolar type was assembled using 6 anodic elements, 5 cathodic elements, 2 terminal cathodic elements of the type schematized in FIG. 1, each of them being 1200 mm high and 1500 mm wide, with a resulting area of 1.8 $m^2$; the anodic elements were connected through the ducts (3) to an anodic gas-disengager, the cathodic elements were similarly connected to a cathodic gas-disengager.

The top of each element was provided with two connections (3, 4) for separately removing the gas-rich and the liquid-rich phases as described in the present invention. In particular, the diameter of the two ducts (3, 4) was respectively of 40 and 10 mm, the length of the portion of duct (3) comprised between the outlet from the element and the point of insertion of duct (4) being 150 mm, the maximum height of the gas area comprised between line (10) and the edge of the flange (1) being 30 mm.

3 anodic elements and 3 cathodic elements were also provided with pressure gauges. The electrolyzer was equipped with 12 ion-exchange membranes, Nafion® 961 produced by Du Pont.

The anodic compartments were fed with a solution of sodium chloride at 300 g/l and the cathodic compartments with a solution of sodium hydroxide at about 30%. Current density was 3000 Ampere/$m^2$, for a total current of 66,000 Ampere fed at the electrolyzer; the average temperature under operation was 85° C., with a voltage of 3.1 Volts. The electrolyzer circulation under these conditions was in the range of 0.5 $m^3$/h per $m^2$ of membrane and the pressure fluctuations had a maximum excursion of about 20 mm of water column, the frequency being approximately of 0.1 –0.2 Hertz. Similar measurement were taken on a similar industrial electrolyzer, equipped with a single outlet for the gas/liquid mixture, respectively chlorine/sodium chloride brine for the anodic elements and hydrogen/sodium hydroxide solution for the cathodic elements. Pressure fluctuations had in this case a maximum intensity of 200 mm in the anodic elements and around 250 mm in cathodic elements, with a frequence ranging around 0.5–0.6 Hertz.

EXAMPLE NO. 2

The chlor-alkali electrolysis, as described in Example 1, was carried out in a bipolar electrolyzer consisting of 10 bipolar elements and 2 end elements as shown in FIG. 5*b*, *1200* mm high and 3000 mm long, equipped with 12 membranes, Nafion® 961 produced by Du Pont.

The current density was also in this case 3000 Ampere/m®, for a total current of 11000 Ampere and an overall voltage of 36 Volt.

2 bipolar elements were provided with pressure gauges in their top.

With an electrolyte circulation of 0.4 $m^3$/h per $m^2$ of membrane, the pressure fluctuations showed a maximum intensity in the range of 20–30 mm of water column, the frequency varying from 0.1 to 0.2 Hertz.

For comparison purposes, measurements were also carried out on a similar industrial electrolyzer, the elements of which were equipped with a single outlet for the gas-liquid mixture. The pressure fluctuations, both anodic and cathodic, had a significant intensity, ranging from 500 to 600 mm of water column, with a frequency of 0.6–0.8 Hertz.

I claim:

1. A device to eliminate pressure fluctuations in the electrolytic elementary cells of an electrolyzer, each electrolytic elementary cell being divided into compartments where gaseous products are formed, the bottom of each of said compartments being provided with inlet means for feeding liquid electrolyte to be electrolyzed, the top of each of said compartments being provided with outlet means for removing said gaseous products and depleted electrolytes, characterized in that a) said outlet means comprise separate ducts 3,4) for removing a liquid-rich phase and a gas-rich phase;

b) the connection of one lower end of ducts (4) for removing the gas-rich phase is located at the top of the compartment above the connection of duct (3) for the removal of the liquid-rich phase to said compartments;

c) the top of said compartment is maintained under pressure to stabilize the level of said liquid-rich phase inside said compartments between said connections of ducts (3,4) to said electrolytic cells whereby ducts (3) are adapted for immersion in the liquid.

2. A device of claim 1 wherein the upper end of duct (4) is inserted into duct (3) to obtain pressure.

3. A device of claim 1 wherein duct (4) is positioned inside duct (3) to obtain pressure.

4. A device of claim 1 wherein duct (4) is connected to a gas-disengager under a hydraulic head to obtain pressure.

5. A device of claim 1 wherein duct (4) is connected to a hydraulic seal system provided with an outlet for gaseous products.

6. A device of claim 1 wherein duct (4) is connected to a common collector equipped with a single pressure-controlling device to obtain pressure.

7. A membrane monopolar electrolyzer provided with anode compartments and cathode compartments separated by a membrane and inlet means and outlet means in each compartment, the improvement comprising each outlet means being equipped with a device of claim 1.

* * * * *